US008238569B2

(12) United States Patent
Jeong et al.

(10) Patent No.: US 8,238,569 B2
(45) Date of Patent: Aug. 7, 2012

(54) METHOD, MEDIUM, AND APPARATUS FOR EXTRACTING TARGET SOUND FROM MIXED SOUND

(75) Inventors: So-young Jeong, Seoul (KR); Kwang-cheol Oh, Yongin-si (KR); Jae-hoon Jeong, Yongin-si (KR); Kyu-hong Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 260 days.

(21) Appl. No.: 12/458,698

(22) Filed: Jul. 21, 2009

(65) Prior Publication Data

US 2009/0279715 A1 Nov. 12, 2009

Related U.S. Application Data

(63) Continuation-in-part of application No. 12/078,942, filed on Apr. 8, 2008.

(30) Foreign Application Priority Data

Oct. 12, 2007 (KR) ..... 10-2007-0103166
Dec. 18, 2008 (KR) ..... 10-2008-0129411

(51) Int. Cl.
*H04R 3/00* (2006.01)

(52) U.S. Cl. ..... 381/73.1; 381/71.13

(58) Field of Classification Search ..... 381/94.7, 381/94.1, 92, 93, 95, 96, 66, 83, 73.1, 71.13
See application file for complete search history.

(56) References Cited

U.S. PATENT DOCUMENTS 7,613,310 B2 * 11/2009 Mao ..... 381/94.7

OTHER PUBLICATIONS

Office Action, mailed Aug. 2, 2011, in U.S. Appl. No. 12/078,942 (10 pp.).
Juyang Weng et al., "Three-dimensional sound localization from a compact non-coplanar array of microphones using tree-based learning", 2001 Acoustical Society of America, 14 pages.
Steven L. Gay et al., "Acoustic Signal Processing for Telecommunication", Leading the Next, 2 pages.
Gary W. Elko, "Superdirectional Microphone Arrays," in "Acoustic Signal Processing for Telecommunication," Chapter 10, (Steven L. Gay & Jacob Benesty eds., Kluwer Academic Publishers 2000) pp. 181-237.
U.S. Appl. No. 12/078,942, filed Apr. 8, 2008, So-young Jeong et al.
Notice of Allowance Office mailed from the U.S. Patent and Trademark Office on Mar. 19, 2012 in the related U.S. Appl. No. 12/078,942.

* cited by examiner

*Primary Examiner* — Zandra Smith
*Assistant Examiner* — Paul Patton
(74) *Attorney, Agent, or Firm* — Staas & Halsey LLP

(57) ABSTRACT

A method, medium, and apparatus for extracting a target sound from a mixed sound. The method includes obtaining the mixed signal from a microphone array, generating a first signal which is emphasized and directed toward a target sound source, and a second signal which is suppressed and directed toward the target sound source, calculating a non-linear filter which is adaptive to at least one of an amplitude ratio of the first signal to the second signal in a time-frequency domain, frequencies of the first and second signals, and a ratio of an interference signal to the mixed signal, and filtering the first signal by the non-linear filter.

14 Claims, 12 Drawing Sheets

METHOD, MEDIUM, AND APPARATUS FOR EXTRACTING TARGET SOUND FROM MIXED SOUND

CROSS-REFERENCE TO RELATED APPLICATIONS

This application is a continuation-in-part of U.S. patent application Ser. No. 12/078,942, filed on Apr. 8, 2008, which claims the benefit of Korean Patent Application No. 10-2007-0103166, filed on Oct. 12, 2007, in the Korean Intellectual Property Office, the disclosures of which are incorporated herein in their entirety by reference. Additionally, this application claims the benefit of Korean Patent Application No. 10-2008-0129411, filed on Dec. 18, 2008, in the Korean Intellectual Property Office, the disclosure of which is incorporated herein in its entirety by reference.

BACKGROUND

1. Field

One or more embodiments relate to a method, medium, and apparatus extracting a target sound from mixed sound, and more particularly, to a method, medium, and apparatus processing mixed sound, which contains various sounds generated by a plurality of sound sources and is input to a portable digital device that may process or capture sounds, such as a cellular phone, a camcorder or a digital recorder, to extract only a target sound desired by a user out of the mixed sound.

2. Description of the Related Art

Part of everyday life involves making or receiving phone calls, recording external sounds, and capturing moving images by using portable digital devices. Various digital devices, such as consumer electronics (CE) devices and cellular phones, use a microphone to capture sound. Generally, a microphone array including a plurality of microphones is utilized to implement stereophonic sound which uses two or more channels as contrasted with monophonic sound which uses only a single channel.

The microphone array including microphones may acquire not only a sound itself but also additional information regarding directivity of the sound, such as the direction or position of the sound. Directivity is a feature that increases or decreases the sensitivity to a sound signal transmitted from a sound source, which is located in a particular direction, by using the difference in the arrival times of the sound signal at each microphone of the microphone array. When sound signals are obtained using the microphone array, a sound signal coming from a particular direction may be emphasized or suppressed.

Research has been conducted regarding a method of removing musical noise or noise caused by a rapid change in an ambient environment when obtaining a mixed signal containing target sound and interference noise by using the microphone array and performing filtering in order to extract a target sound signal from the mixed signal. The International Telecommunication Union (ITU) has used the perceptual evaluation speech quality (PESQ) index indicating the quality of sound being objectively evaluated based on a comparison of input sound and output sound.

As used herein, the term "sound source" denotes a source which radiates sounds, that is, an individual speaker included in a speaker array. In addition, the term "sound field" denotes a virtual region formed by a sound which is radiated from a sound source, that is, a region which sound energy reaches.

The term "sound pressure" denotes the power of sound energy which is represented using the physical quantity of pressure.

SUMMARY

One or more embodiments include a method, medium, and apparatus extracting a target sound, in which a target sound may be clearly separated from mixed sound containing a plurality of sound signals and inputted to a microphone array.

One or more embodiments include a method and apparatus extracting a target sound from a mixed sound irrespective of a rapid change in an ambient environment.

One or more embodiments include a computer readable recording medium on which a program causing a computer to execute the above methods is recorded.

Additional aspects and/or advantages will be set forth in part in the description which follows and, in part, will be apparent from the description, or may be learned by practice of the invention.

Example embodiments may provide a method of extracting a target sound. The method includes receiving a mixed signal through a microphone array, generating a first signal whose directivity is emphasized toward a target sound source and a second signal whose directivity toward the target sound source is suppressed based on the mixed signal, and extracting a target sound signal from the first signal by masking an interference sound signal, which is contained in the first signal, based on a ratio of the first signal to the second signal.

Example embodiments may include a computer-readable recording medium on which a program for executing the method of extracting a target sound source is recorded.

Example embodiments may include an apparatus for extracting a target sound. The apparatus includes a microphone array receiving a mixed signal, a beam former generating a first signal whose directivity is emphasized toward a target sound source and a second signal whose directivity toward the target sound source is suppressed based on the mixed signal, and a signal extractor extracting a target sound signal from the first signal by masking an interference sound signal, which is contained in the first signal, based on a ratio of the first signal to the second signal.

Example embodiments may include a method of adaptively extracting a target sound signal from a mixed signal, the method including obtaining the mixed signal from a microphone array, generating a first signal which is emphasized and directed toward a target sound source, and a second signal which is suppressed and directed toward the target sound source, calculating a non-linear filter which is adaptive to at least one of an amplitude ratio of the first signal to the second signal in a time-frequency domain, frequencies of the first and second signals, and a ratio of an interference signal to the mixed signal, and filtering the first signal by the non-linear filter.

Example embodiments may include a computer readable recording medium on which is recorded a program causing a computer to execute the method of adaptively extracting a target sound signal.

Example embodiments may include an apparatus for adaptively extracting a target sound signal from a mixed signal, the apparatus including a microphone array receiving the mixed signal, a beam former generating a first signal which is emphasized and directed toward a target sound source, and a second signal which is suppressed and directed toward the target sound source, a non-linear filter calculation unit calculating a non-linear filter which is adaptive to at least one of an amplitude ratio of the first signal to the second signal in a time-frequency domain, frequencies of the first and second signals, and a ratio of an interference signal to the mixed signal, and a signal extractor extracting the target sound signal from the first signal by filtering the first signal by the non-linear filter.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
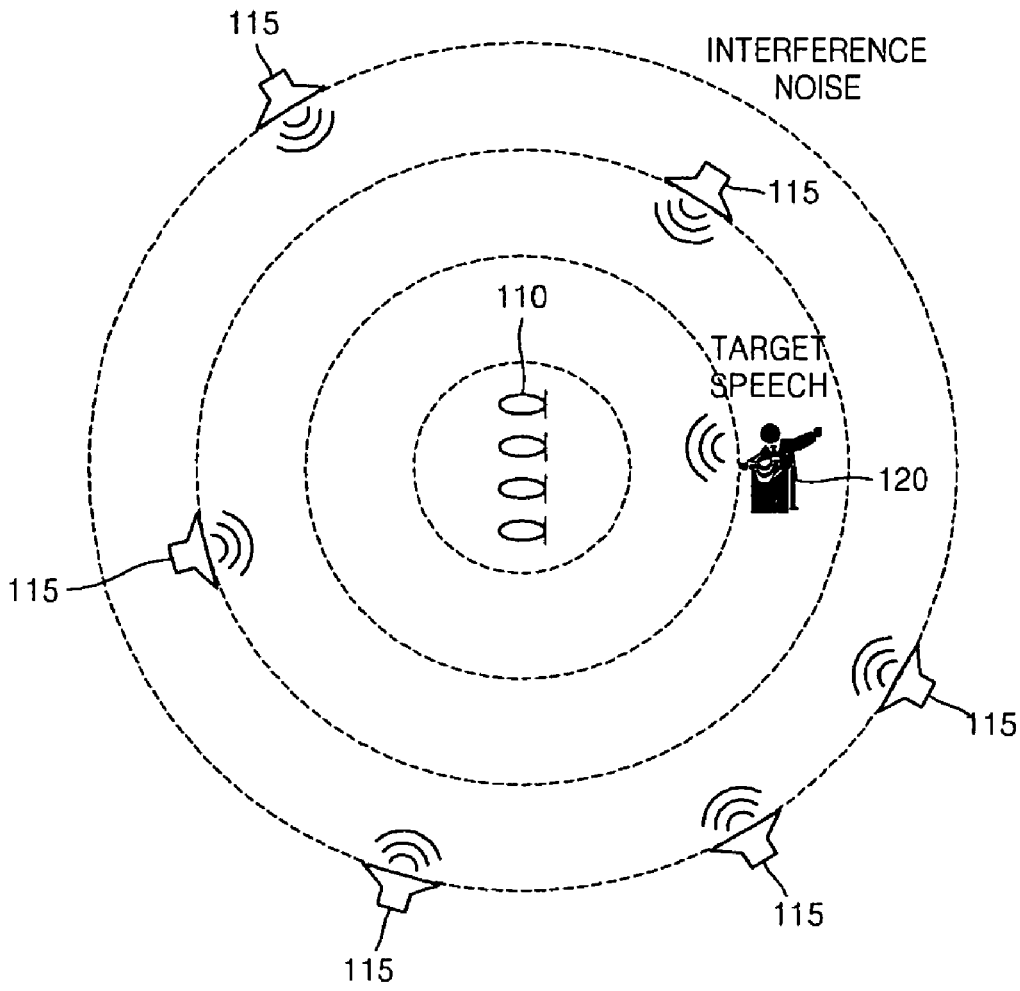
FIG. 1 illustrates a problematic situation that embodiments address.

Reference will now be made in detail to example embodiments, examples of which are illustrated in the accompanying drawings, wherein like reference numerals refer to the like elements throughout. In this regard, example embodiments may have different forms and should not be construed as being limited to the descriptions set forth herein. Accordingly, the example embodiments are merely described below, by referring to the figures, to explain aspects of the present description.

Recording or receiving sound by using portable digital devices may be performed more often in noisy places with various noises and ambient interference noises than in quiet places without ambient interference noises. When only voice communication was possible using a cellular phone, interference noises input to a microphone included in the cellular phone was not a big problem since the distance between a user and the cellular phone is very close. However, since video and speaker-phone communication is now possible using communication devices, the effect of interference noises on sound signals generated by a user of the communication device has relatively increased, thereby hindering clear communication. In this regard, a method of extracting a target sound from a mixed sound is increasingly required by various sound acquiring devices such as consumer electronics (CE) devices and cellular phones with built-in microphones.

FIG. 1 illustrates a problematic situation that embodiments address. In FIG. 1, the distance between a microphone array 110 and each adjacent sound source is represented in a concentric circle. Referring to FIG. 1, a plurality of sound sources 115, 120, are located around the microphone array 110, and each sound source is located in a different direction and at a different distance from the microphone array 110. Various sounds generated by the sound sources 115, 120, are mixed into a single sound (hereinafter, referred to as a mixed sound), and the mixed sound is input to the microphone array 110. In this situation, a clear sound generated by a target sound source is to be obtained from the mixed sound.

The target sound source may be determined according to an environment in which various embodiments are implemented. Generally, a dominant signal from among a plurality of sound signals contained in a mixed sound signal may be determined to be a target sound source. That is, a sound signal having the highest gain or sound pressure may be determined as a target sound source. Alternatively, the directions or distances of the sound sources 115, 120, from the microphone array 110 may be taken into consideration to determine a target sound source. That is, a sound source which is located in front of the microphone array 110 or located closer to the microphone array 110, is more likely to be a target sound source. In FIG. 1, a sound source 120 located close to a front side of the microphone array 110 is determined as a target sound source. Thus, in the situation illustrated in FIG. 1, a sound generated by the sound source 120 is to be extracted from the mixed sound which is input to the microphone array 110.

As described above, since a target sound source is determined according to the environment in which various embodiments are implemented, it will be understood by those of ordinary skill in the art that various methods other than the above two methods may be used to determine the target sound source.

Figure 2A:
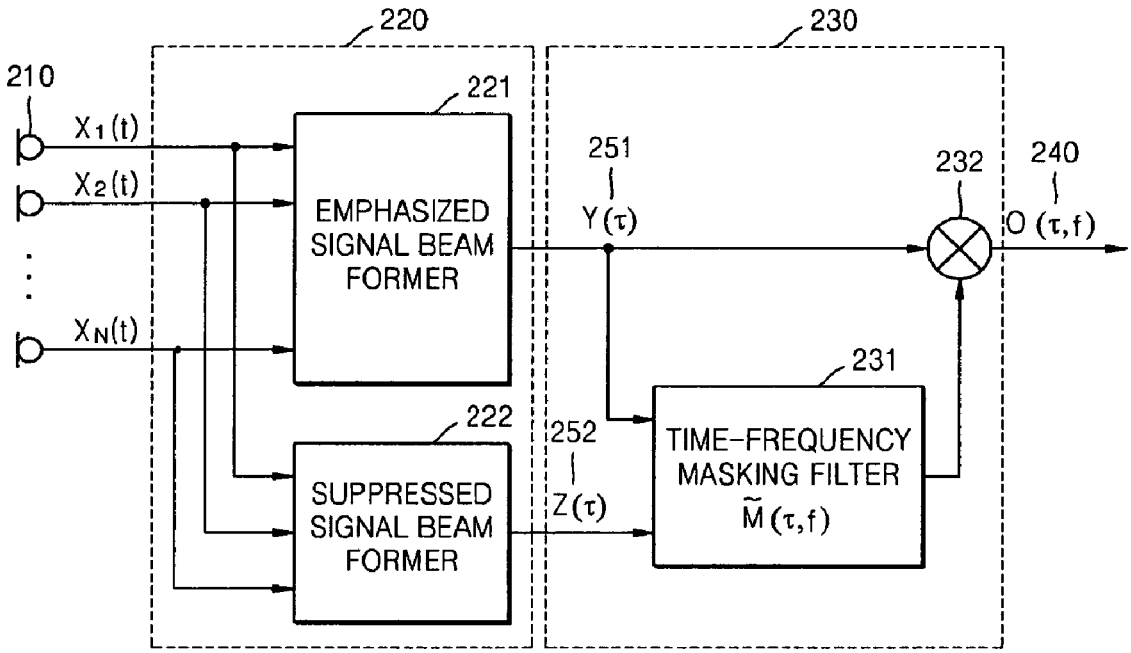
FIGS. 2A and 2B are block diagrams of example embodiments of respective apparatus for extracting a target sound signal.
Figure 2B:
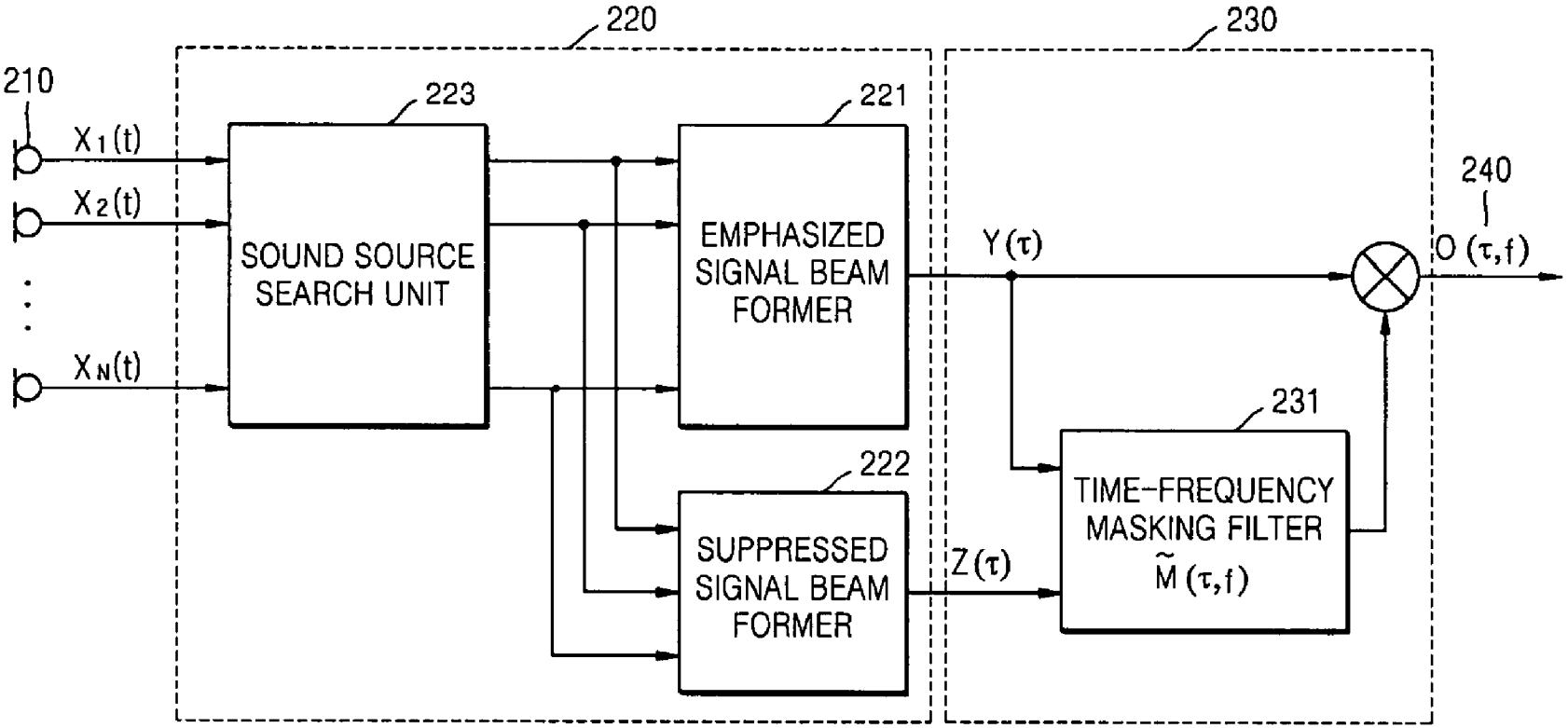

FIGS. 2A and 2B are block diagrams of example embodiments of respective apparatus for extracting a target sound signal. The apparatus of FIG. 2A may be used when information regarding the direction in which a target sound source is located is given, and the apparatus of FIG. 2B may be used when the information is not given.

The configuration of the apparatus of FIG. 2A is based on an assumption that the direction in which a target sound source is located has been determined using various methods described above with reference to FIG. 1. Referring to FIG. 2A, the apparatus includes a microphone array 210, a beam-former 220, and a signal extractor 230.

The microphone array 210 obtains sound signals generated by a plurality of adjacent sound sources in the form of a mixed sound signal. Since the microphone array 210 includes a plurality of microphones, a sound signal generated by each sound source may arrive at each microphone at a different time, depending on the position of the corresponding sound source and the distance between the corresponding sound source and each microphone. It will be assumed that N sound signals $X_1(t)$ through $X_N(t)$ are received through N microphones of the microphone array 210, respectively.

Based on the sound signals $X_1(t)$ through $X_N(t)$ received through the microphone array 210, the beam former 220 generates signals whose directivity toward the target sound source is emphasized and signals whose directivity toward the target sound source is suppressed. The generation of these signals is respectively performed using an emphasized signal beam former 221 and a suppressed signal beam former 222.

In order to receive a clear target sound signal which is mixed with background noise, a microphone array having two or more microphones generally functions as a spatial filter which increases the amplitude of each sound signal, which is received through the microphone array, by assigning an appropriate weight to each sound signal and spatially reduces noise when the direction of the target sound signal is different from that of an interference noise signal. In this case, the spatial filter is referred to as a beam former. In order to amplify or extract a target sound signal from noise which is coming from a different direction from that of the target sound signal, a microphone array pattern and phase differences between signals which are input to a plurality of microphones, respectively, need to be obtained. This signal information may be obtained using a plurality of beam-forming algorithms.

Major examples of beam-forming algorithms which may be used to amplify or extract a target sound signal include a delay-and-sum algorithm and a filter-and-sum algorithm. In the delay-and-sum algorithm, the position of a sound source is identified based on a relative period of time by which a sound signal generated by the sound source has been delayed before arriving at a microphone. In the filter-and-sum algorithm, output signals are filtered using a spatially linear filter in order to reduce the effects of two or more signals and noise in a sound field formed by sound sources. These beam-forming algorithms are well known to those of ordinary skill in the art to which the embodiment pertains.

The emphasized signal beam former 221 illustrated in FIG. 2A emphasizes directional sensitivity toward the target sound source, thereby increasing sound pressure of the target sound source signal. A method of adjusting directional sensitivity will now be described with reference to FIGS. 3A and 3B.

Figure 3A:
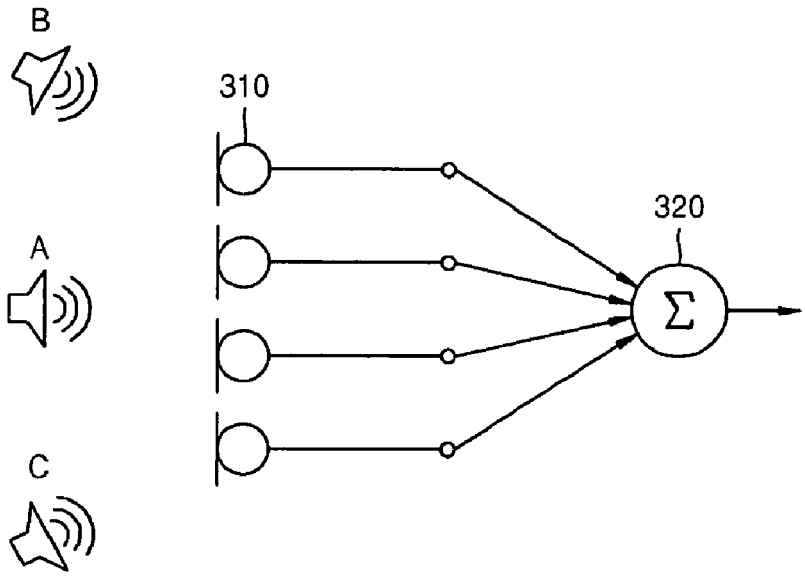
FIGS. 3A and 3B are block diagrams of an example embodiment of a target sound-emphasizing beam former.
Figure 3B:
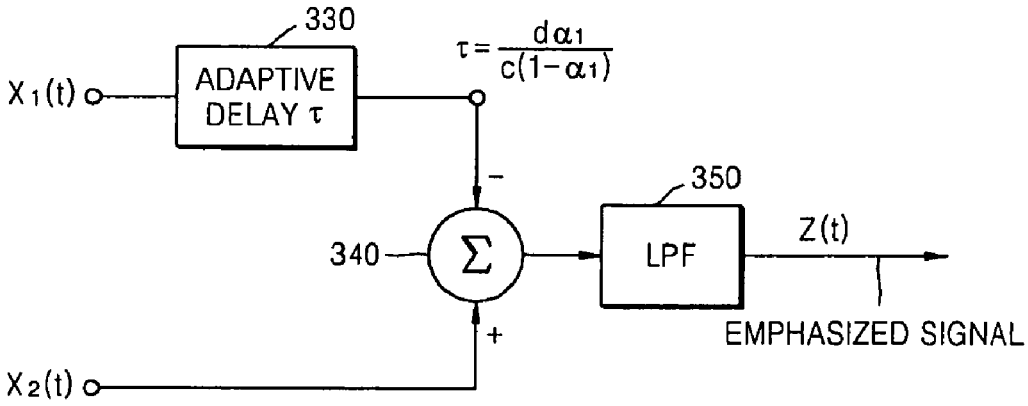

FIGS. 3A and 3B are block diagrams of example embodiments of a target sound-emphasizing beam former. A method using a fixed filter and an alternative method using an adaptive delay is illustrated in FIGS. 3A and 3B respectively.

In FIG. 3A, it is assumed that a target sound source is placed in front of a microphone array 310. Based on this assumption, sound signals received through the microphone array 310 are added by an adder 320 to increase sound pressure of the target sound source, which, in turn, emphasizes directivity toward the target sound source. Referring to FIG. 3A, a plurality of sound sources are located at positions, including positions A, B and C, respectively. Since it is assumed that the target sound source is located in front of the microphone array 310, that is, at the position A, in an example embodiment, sounds generated by the sound sources located at the positions B and C are interference noises.

When a mixed sound signal is input to the microphone array 310, a sound signal, which is included in the mixed sound signal and transmitted from the position A in front of the microphone array 310 may also be input to the microphone array 310. In this case, the phase and size of the sound signal received by each microphone of the microphone array 310 may be almost identical. The adder 320 adds the sound signals, which are received by the microphones of the microphone array 310, respectively, and outputs a sound signal having increased gain and unchanged phase.

On the other hand, when a sound signal transmitted from the position B or C is input to the microphone array 310, it may arrive at each microphone of the microphone array 310 at a different time since each microphone is at a different distance and angle from the sound source located at the position B or C. That is, the sound signal generated by the sound source at the position B or C may arrive at a microphone, which is located closer to the sound source, earlier and may arrive at a microphone, which is located further from the sound source, relatively later.

When the adder 320 adds the sound signals respectively received by the microphones at different times, the sound signals may partially offset each other due to the difference in their arrival times. Otherwise, the gains of the sound signals may be reduced due to the differences between the phases thereof. Although the phases of the sound signals do not differ from one another by the same amounts, the gain of the sound signal transmitted from the position B or C is reduced relatively more than that of the sound signal transmitted from the position A. Therefore, as in the present embodiment, the directional sensitivity toward the target sound source in front of the microphone array 310 may be enhanced using the microphone array 310, which includes the microphones spaced at regular intervals, and the adder 320.

FIG. 3B is a block diagram of another embodiment of a target sound-emphasizing beam former for increasing directivity toward a target sound source. For the simplicity of description, a first-order differential microphone structure consisting of only two microphones is used.

When sound signals $X_1(t)$ and $X_2(t)$ are received through a microphone array, a delay unit, for example, an adaptive delay unit 330, delays the sound signal $X_1(t)$ by a predetermined period of time by performing adaptive delay control. Then, a subtractor 340 subtracts the delayed sound signal $X_1(t)$ from the sound signal $X_2(t)$. Consequently, a sound signal having directivity toward a certain target sound source is generated. Finally, a low-pass filter (LPF) 350 filters the generated sound signal and outputs an emphasized signal which is independent of frequency changes of the sound signal ("Acoustical Signal Processing for Telecommunication," Steven L. Gay and Jacob Benesty, Kluwer Academic Publishers, 2000). The above beam former is referred to as a delay-and-subtract beam former and will be only briefly described in relation to example embodiments since it may be easily understood by those of ordinary skill in the art to which the example embodiments pertain.

Generally, directional control factors, such as the gap between microphones of a microphone array and delay times of sound signals being respectively transmitted to the microphones, are widely used to determine the directional response of the microphone array. For example, the relationship between the directional control factors is defined, for example, by Equation 1 below.

$$\tau = \frac{d\alpha_1}{c(1-\alpha_1)} \qquad \text{Equation 1}$$

Here, $\tau$ is an adaptive delay which determines the directional response of the microphone array, d is the gap between the microphones, $\alpha_1$ is a control factor introduced to define the relationship between the directional control factors, and c is the velocity of sound wave in air, that is, 340 m/sec.

In FIG. 3B, the adaptive delay unit 330 determines an adaptive delay by using Equation 1, based on a direction of a target sound source, of which the signals featuring such directivity are to be emphasized, and delays the sound signal $X_1(t)$ by a value of the determined delay. Then, the subtractor 340 subtracts the delayed sound signal $X_1(t)$ from the sound signal $X_2(t)$. Due to this delay, each sound signal arrives at each microphone of the microphone array at a different time. Consequently, a signal that is to be emphasized, featuring directivity toward a particular target sound source, may be obtained from the sound signals $X_1(t)$ and $X_2(t)$ received through the microphone array.

A sound pressure field of the sound signal $X_1(t)$ delayed by the adaptive delay unit 330 is defined as a function of each angular frequency of the sound signal $X_1(t)$ and an angle at which the sound signal $X_1(t)$ from a sound source is incident to the microphone array. The sound pressure field is changed by various factors such as the gap between the microphones or an incident angle of the sound signal $X_1(t)$. Of these factors, the frequency or amplitude of the sound signal $X_1(t)$ varies according to properties thereof. Therefore, it is difficult to control the sound pressure field of the sound signal $X_1(t)$. For this reason, it is desirable for the sound pressure field of the sound signal $X_1(t)$ to be controlled using the adaptive delay of Equation 1, in that Equation 1 is irrespective of changes in the frequency or amplitude of the sound signal $X_1(t)$.

The LPF 350 ensures that frequency components, which are contained in the sound pressure field of the sound signal $X_1(t)$, remain unchanged in order to restrain the sound pressure field from being changed by changes in the frequency of the sound signal $X_1(t)$. Thus, after the LPF 350 filters a sound signal output from the subtractor 340, the directivity toward the target sound source may be controlled using the adaptive delay of Equation 1, irrespective of the frequency or amplitude of the sound signal. That is, an emphasized sound signal Z(t) featuring directivity toward the target source and thus is emphasized, may be generated by the target sound-emphasizing beam former of FIG. 3B.

The target sound-emphasizing beam formers according to two exemplary embodiments have been described above with reference to FIGS. 3A and 3B. Contrary to a target sound-emphasizing beam former, a target sound-suppressing beam former suppresses directivity toward a target sound source and thus attenuates a sound signal which is transmitted from the direction in which the target sound source is located.

Figure 4A:
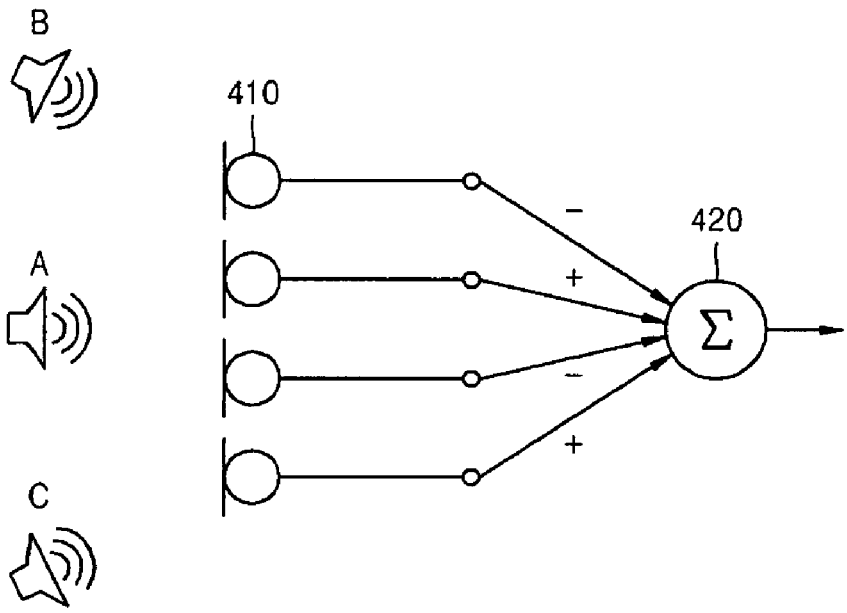
FIGS. 4A and 4B are block diagrams of an example embodiment of a target sound-suppressing beam former.
Figure 4B:
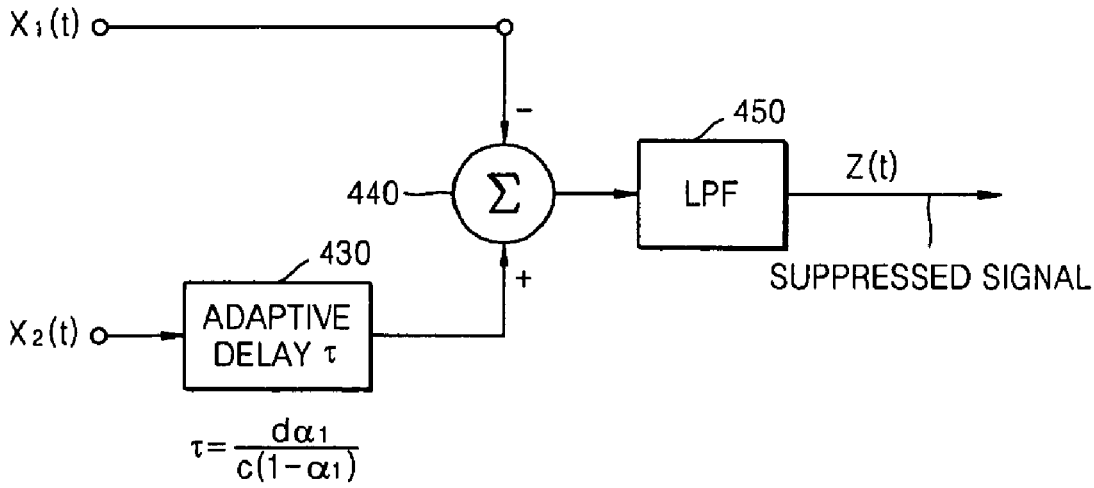

FIGS. 4A and 4B are block diagrams of example embodiments of target sound-suppressing beam formers. A method using a fixed filter and an alternative method using an adaptive delay is illustrated in FIGS. 4A and 4B respectively.

As in FIG. 3A, it is assumed in FIG. 4A that a target sound source is placed in front of a microphone array 410. In addition, it is assumed that sound sources are located at positions including positions A, B and C, respectively. As in FIG. 3A, since it is assumed in FIG. 4A that the target sound source is located in front of the microphone array 410, that is, at the position A, sounds generated by the sound sources located at the positions B and C are interference noises.

In FIG. 4A, positive and negative signal values are alternately assigned to sound signals which are received through the microphone array 410. Then, an adder 420 adds the sound signals to suppress directivity toward the target sound source. The positive and negative signal values illustrated in FIG. 4A may be assigned to the sound signals by multiplying the sound signals by a matrix that may be embodied as (−1, +1, −1, +1). A matrix, which alternately assigns positive and negative signs to sound signals input to adjacent microphones in order to attenuate the sound signals, is referred to as a blocking matrix.

A process of suppressing directivity will now be described in more detail. When a mixed sound signal is input to the microphone array 410, a sound signal, which is included in the mixed sound signal and transmitted from the position A in front of the microphone array 410 may also be input to the microphone array 410. In this case, the phases and sizes of the sound signals received by each pair of adjacent microphones among four microphones of the microphone array 410 may be very similar to each other. That is, the sound signals received through first and second, second and third, or third and fourth microphones may be very similar to each other.

Therefore, after opposite signs are assigned to the sound signals received through each pair of adjacent microphones, if an adder 420 adds the sound signals, the sound signals assigned with opposite signs may offset each other. Consequently, the gain or sound pressure of the sound signal from the sound source located at the position A in front of the microphone array 410 is reduced, which, in turn, suppresses directivity toward the target sound source.

On the other hand, when a sound signal generated by the sound source at the position B or C is input to the microphone array 410, each microphone of the microphone array 410 may experience a delay in receiving the sound signal. In this case, the duration of the delay may depend on the distance between the sound source and each microphone. That is, the sound signal transmitted from the position B or C arrives at each microphone at a different time. Due to the difference in the arrival times of the sound signal at the microphones, even if opposite signs are assigned to the sound signals received by each pair of adjacent microphones and then the sound signals are added by the adder 420, the sound signals do not greatly offset each other due to their different arrival times. Therefore, if opposite signs are assigned to the sound signals received by each pair of adjacent microphones of the microphone array 410 and then if the sound signals are added by the adder 420 as in the present embodiment, directivity toward the target sound source in front of the microphone array 410 may be suppressed.

FIG. 4B is a block diagram of a target sound-suppressing beam former for suppressing directivity toward a target sound source. Since the target sound-beam former of FIG. 4B also uses the first-order differential microphone structure described above with reference to FIG. 3B, a description of such an exemplary embodiment will focus on the difference between the beam formers of FIGS. 3B and 4B. When sound signals $X_1(t)$ and $X_2(t)$ are received through a microphone array, a delay unit, for example, an adaptive delay unit 430, delays the sound signal $X_2(t)$ by a predetermined period of time through an adaptive delay control. Then, contrary to the subtractor 340 in FIG. 3, a subtractor 440 subtracts the sound signal $X_1(t)$ from the delayed sound signal $X_2(t)$. Finally, an LPF 450 filters the subtraction result and outputs a suppressed sound signal Z(t) which is suppressed as compared to a sound signal transmitted from the direction of the target sound source.

The current exemplary embodiment is identical to the previous exemplary embodiment illustrated in FIG. 3B in that directional control factors are controlled using Equation 1 described above to control an adaptive delay. However, the current exemplary embodiment is different from the previous exemplary embodiment in that the adaptive delay is controlled to suppress directivity toward the target sound source. That is, the target sound-suppressing beam former of FIG. 4B reduces the sound pressure of a sound signal transmitted from the direction, in which the target sound source is located, to microphone array. The present embodiment is also different from the previous embodiment in that the subtractor 440 assigns opposite signs to input signals and subtracts the input signals from each other in order to suppress directivity toward the target sound source.

The beam formers which emphasize or suppress directivity toward a target sound source according to various embodiments have been described above with reference to FIGS. 3A through 4B. Now, referring back to FIG. 2A, the beam former 220 generates an emphasized signal Y(τ) 251 and a suppressed signal Z(τ) 252 using the emphasized signal beam former 221 and the suppressed signal beam former 222, respectively. The beam former 220 may use a number of effective control techniques which emphasize or suppress directivity toward a target source based on the directivity of sound delivery.

The signal extractor 230 may include a time-frequency masking filter (hereinafter, masking filter) 231 and a mixer 232. The signal extractor 230 extracts a target sound signal from the emphasized signal Y(τ) 251 by using the masking filter 231 which is set according to a ratio of the amplitude of the emphasized signal Y(τ) 251 to that of the suppressed signal Z(τ) 252 in a time-frequency domain. In this case, the emphasized signal Y(τ) 251 and the suppressed signal Z(τ) 252 are input values. As used herein, the term "masking" refers to a case where a signal suppresses other signals when a number of signals exist at the same time or at adjacent times. Thus, masking is performed based on the expectation that a clearer sound signal will be extracted if sound signal components may suppress interference noise components when a sound signal coexists with interference noise.

Figure 5:
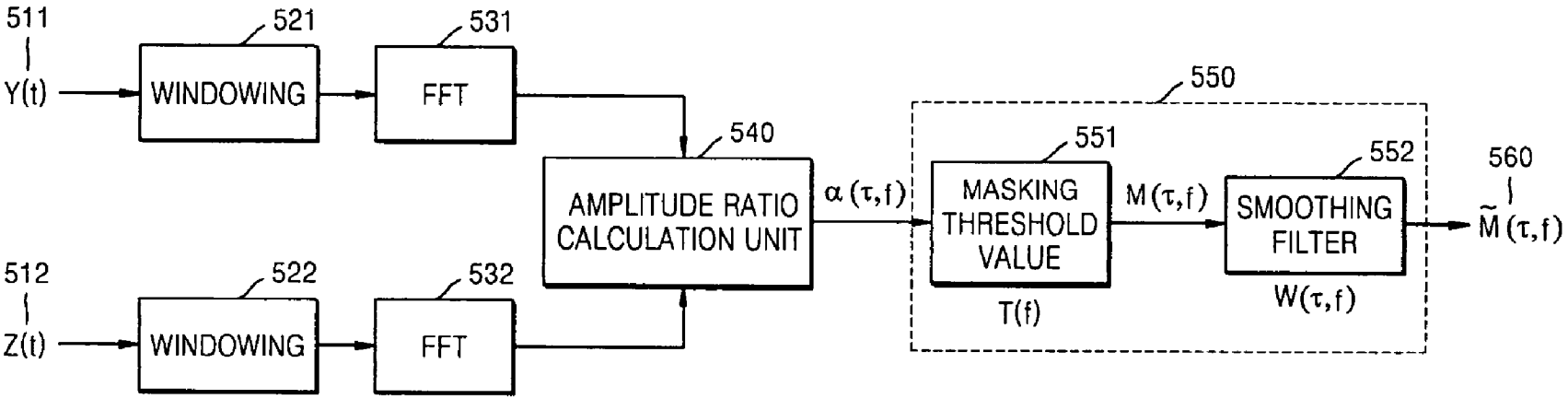
FIG. 5 is a block diagram of an example embodiment of a masking filter.
Figure 8:
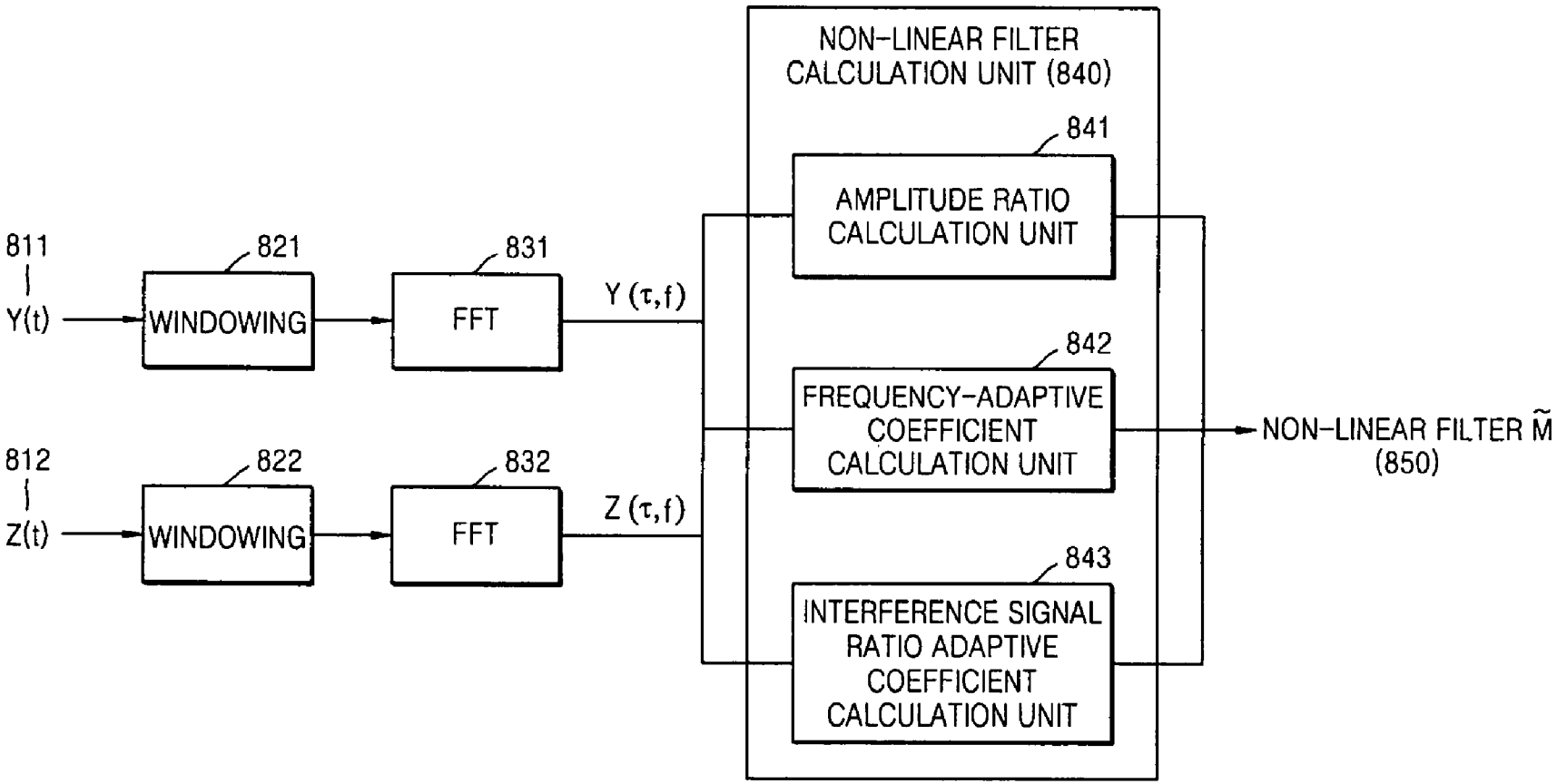
FIG. 8 illustrates a block diagram of a non-linear filter which is another example embodiment of a masking filter and is adaptive to at least one of an amplitude ratio, frequency, and a ratio of an interference noise signal to a mixed signal.

The masking filter 231 receives the emphasized signal Y(τ) 251 and the suppressed signal Z(τ) 252 and filters them based on a ratio of the amplitude of the emphasized signal Y(τ) 251 to that of the suppressed signal Z(τ) 252 in the time-frequency domain. Then, the signal extractor 230 extracts a target sound signal O(τ,f) 240 from which interference noise is removed. Filtering performed by the signal extractor 230 by using the masking filter 231 includes soft masking filtering using a binary masking filter, and soft masking filtering that is adaptive to an amplitude ratio. Nonlinear filtering is an embodiment of soft masking filtering and is adaptive to not only an amplitude ratio but also frequency or a ratio of an interference noise signal to a mixed signal. FIG. 5 illustrates a binary masking filter and a soft masking filter which is adaptive to an amplitude ratio. FIG. 8 illustrates a non-linear filter which is adaptive to at least one of an amplitude ratio, frequency, and ratio of an interference noise signal to a mixed signal. A filtering process performed by the masking filter 231 of the signal extractor 230 will now be described in more detail with reference to FIG. 5.

FIG. 5 is a block diagram of an example embodiment of a masking filter. Referring to FIG. 5, the masking filter window functions 521 and 522, fast Fourier transform (FFT) units 531 and 532, an amplitude ratio calculation unit 540, and a masking filter-setting unit 550.

The window functions 521 and 522 reconfigure an emphasized signal Y(t) 511 and a suppressed signal Z(t) 512 generated by a beam former (not shown) into individual frames, respectively. In this case, a frame denotes each of a plurality of units into which a sound signal is divided according to time. In addition, a window function denotes a type of filter used to divide a successive sound signal into a plurality of sections, that is, frames, according to time and process the frames. In the case of digital signal processing, a signal is input to a system, and a signal output from the system is represented using convolutions. To limit a given target signal to a finite signal, the target signal is divided into a plurality of individual frames by a window function and processed accordingly. A major example of the window function is a Hamming window, which may be easily understood by those of ordinary skill in the art to which the embodiment pertains.

The emphasized signal Y(t) 511 and the suppressed signal Z(t) 512 reconfigured by the window functions 521 and 522 are transformed into signals in the time-frequency domain by the FFT units 531 and 532 for ease of calculation. Then, an amplitude ratio may be calculated based on the signals in the time-frequency domain as given by Equation 2 below, for example.

$$\alpha(\tau, f) = \frac{|Y(\tau, f)|}{|Z(\tau, f)|} \qquad \text{Equation 2}$$

Here, τ indicates time, f indicates frequency, and an amplitude ratio α(τ,f) is represented by a ratio of absolute values of an emphasized signal Y(τ,f) and a suppressed signal Z(τ,f). That is, the amplitude ratio α(τ,f) in Equation 2 denotes an amplitude ratio of an emphasized signal and a suppressed signal which are included in individual frames in the time-frequency domain.

The masking filter-setting unit 550 illustrated in FIG. 5 sets a soft masking filter 560 based on the amplitude ratio α(τ,f) which is calculated by the amplitude ratio calculation unit 540. Two methods of setting a masking filter are suggested below as exemplary embodiments.

First, a masking filter may be set using a binary masking filter and a soft masking filter calculated from the binary masking filter. Here, the binary masking filter is a filter which produces only zero and one as output values. The binary masking filter is also referred to as a hard masking filter. On the other hand, the soft masking filter is a filter which is controlled to linearly and gently increase or decrease in response to the variation of binary numbers output from the binary masking filter.

The masking filter-setting unit 550 illustrated in FIG. 5 sets the soft masking filter 560 by using the binary masking filter described above. The binary masking filter may be calculated from a frequency ratio as defined by Equation 3 below, for example.

$$M(\tau, f) = \begin{cases} 1, & \text{if } \alpha(\tau, f) \geq T(f) \\ 0, & \text{if } \alpha(\tau, f) < T(f) \end{cases} \qquad \text{Equation 3}$$

Here, T(f) indicates a masking threshold value according to a frequency f of a sound signal. As the masking threshold value T(f), an appropriate value, which may be used to determine whether a corresponding frame is a target signal or an interference noise, is experimentally obtained according to various embodiments. Since the binary masking filter outputs only binary values of zero and one, it is referred to as a binary masking filter or a hard masking filter.

In Equation 3, if the amplitude ratio α(τ,f) is greater than or equal to the masking threshold value T(f), that is, if an emphasized signal is greater than a suppressed signal, the binary masking filter is set to one. On the contrary, if the amplitude ratio α(τ,f) is less than the masking threshold value T(f), that is, if the emphasized signal is smaller than the suppressed signal, the binary masking filter is set to zero. Masking in the time-frequency domain requires relatively less computation even when the number of microphones in a microphone array is less than that of adjacent sound sources including a target sound source. This is because the number of masking filters equalling the number of sound sources may be generated and perform a masking operation in order to extract a target sound. The number of microphones does not greatly affect the masking operation. Therefore, even when there are a plurality of sound sources, the masking filters may perform in a superior manner.

In FIG. 5, the amplitude ratio $\alpha(\tau,f)$ calculated by the amplitude ratio calculation unit 540 is compared to a masking threshold value 551 and thus defined as a binary masking filter $M(\tau,f)$. Then, a smoothing filter 552 removes musical noise which may be generated due to the application of the binary masking filter $M(\tau,f)$. In this case, musical noise is residual noise which remains noticeable by failing to form groups with adjacent frames in a mask of individual frames defined by the binary masking filter.

Until now, various methods of removing the musical noise have been suggested. A popular example is a Gaussian filter. The Gaussian filter assigns a highest weight to a mean value among values of a plurality of signal blocks and lower weights to the other values of the signal blocks. Thus, the mean value is best filtered by the Gaussian filter, and a value further from the mean value is less filtered by the Gaussian filter.

Figure 6:
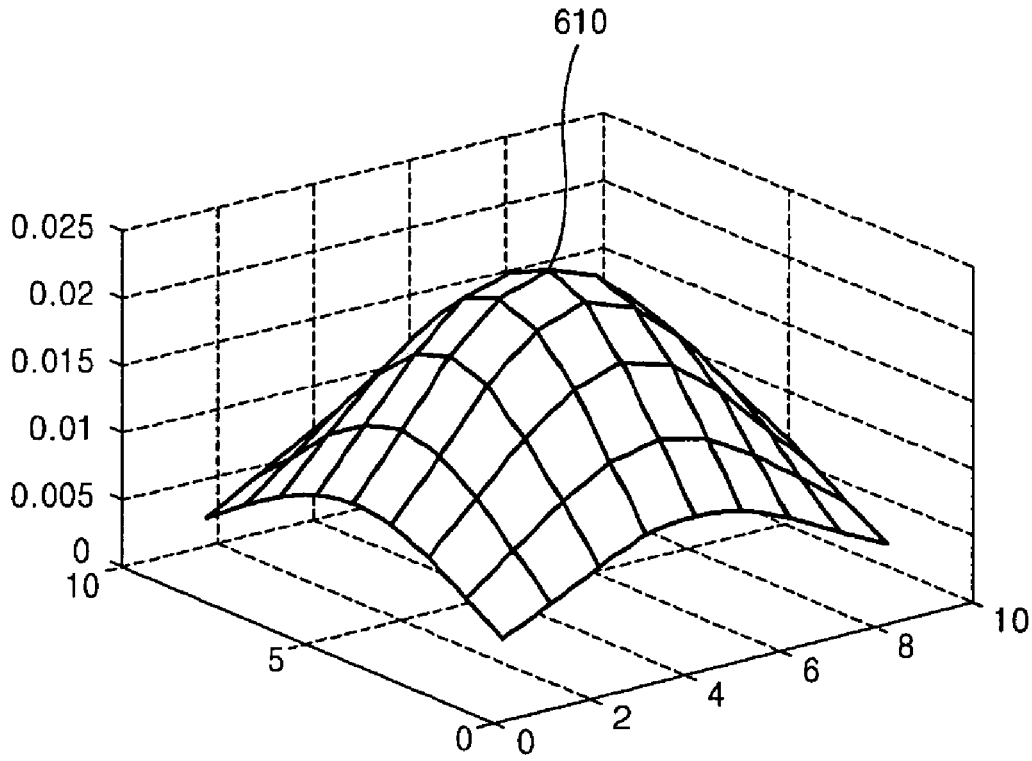
FIG. 6 is a graph illustrating a Gaussian filter which may be used to implement an example embodiment of a masking filter.

FIG. 6 is a graph illustrating the Gaussian filter which may be used to implement an exemplary embodiment of a masking filter. Two horizontal axes of the graph indicate signal blocks, and a vertical axis of the graph indicates the filtering rate of the Gaussian filter. Referring to FIG. 6, a highest weight is given to a center 610 of the signal blocks and that the center 610 may be filtered.

Other than the Gaussian filter, various other filters may be used, such as a median filter which selects a median value from values of signal blocks of an equal size in horizontal and vertical directions. These various filters may be obvious to those of ordinary skill in the art to which the embodiment pertains, and thus a detailed description thereof will be omitted.

Using the above methods, the binary masking filter $M(\tau,f)$ illustrated in FIG. 5 is multiplied by the smoothing filter 552 and finally set as the soft masking filter 560. The set soft masking filter 560 may be defined by Equation 4, for example.

$$\tilde{M}(\tau,f)=W(\tau,f)\otimes M(\tau,f) \qquad \text{Equation 4}$$

Here, $W(\tau,f)$ indicates a Gaussian filter used as a smoothing filter. That is, in Equation 4, a soft masking filter is a Gaussian filter multiplied by a binary masking filter.

Above, the method of setting a soft masking filter using a binary masking filter has been descried. Next, a method of directly setting a soft masking filter by using an amplitude ratio will be described as another exemplary embodiment.

In this next exemplary embodiment, the masking filter-setting unit 550 does not use a binary masking filter defined by the masking threshold value 551. Instead, the masking filter-setting unit 550 may model a sigmoid function which may directly set the soft masking filter 560 based on the amplitude ratio $\alpha(\tau,f)$ calculated by the amplitude ratio calculation unit 540. The sigmoid function is a special function which transforms discontinuous and non-linear input values into continuous and linear values between zero and one. The sigmoid function is a type of transfer function which defines a transformation process from input values into output values. In particular, the sigmoid function is widely used in neural network theory. That is, when a model is developed, it is difficult to determine an optimum variable and an optimum function due to many input variables. Thus, according to neural network theory, the prediction capability of the model is enhanced based on learning through data accumulation, and the sigmoid function is widely used in this neural network theory.

In the current exemplary embodiment, the amplitude ratio $\alpha(\tau,f)$ is transformed into a value between zero and one by using the sigmoid function. Accordingly, the soft masking filter 560 may be directly set without using a binary masking filter.

Figure 7:
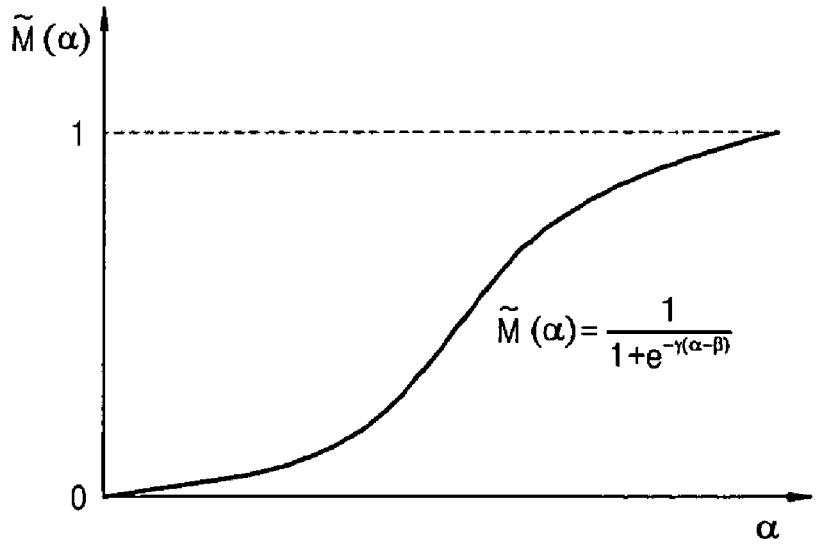
FIG. 7 is a graph illustrating a sigmoid function which may be used to implement another example embodiment of a masking filter.

FIG. 7 is a graph illustrating a sigmoid function which may be used to implement another embodiment of a masking filter. The sigmoid function of FIG. 7 is obtained after a general sigmoid function is moved to the right by a predetermined value $\beta$ to have a value of zero at the origin. In FIG. 7, a horizontal axis indicates an amplitude ratio $\alpha$, and a vertical axis indicates a soft masking filter. The relationship between the amplitude ratio $\alpha$ and the soft masking filter may be defined by Equation 5 below, for example.

$$\tilde{M}(\tau,f)=\frac{1}{1+e^{-\gamma\cdot\alpha(\tau,f)}} \qquad \text{Equation 5}$$

Here, $\gamma$ is a variable indicating the inclination of the sigmoid function. It is apparent from Equation 5 and FIG. 7 that the sigmoid function receives the amplitude ratio $\alpha$, which is a discontinuous and arbitrary value, and outputs a continuous value between zero and one. Therefore, the masking filter-setting unit 550 may directly set the soft masking filter 560 without comparing the amplitude ratio $\alpha(\tau,f)$ calculated by the amplitude ratio calculation unit 540 to the masking threshold value 551.

FIG. 8 is a block diagram of a non-linear filter 850 which is another example embodiment of a masking filter and is adaptive to at least one of an amplitude ratio, frequency and a ratio of an interference noise signal to a mixed signal. The non-linear filter 850 which is adaptive to various variables is needed in order to remove either noise that is discontinuously or instantaneously generated, or musical noise. Thus, high-sensitivity filtering may be performed using a non-linear filter which is adaptive to an amplitude ratio of an emphasized signal Y(t) to a suppressed signal Z(t), frequency, and a ratio of an interference noise signal to a mixed signal. Also, it is possible to effectively remove noise signals unexpectedly generated when the gaps between microphones in a microphone array are short, and to prevent musical noise from newly being generated when a noise signal is removed, thereby increasing the perceptual evaluation of speech quality (PESQ) index.

The non-linear filter 850 is an embodiment of the masking filer 560 and uses a function having non-linear response characteristics in the time-frequency domain. In the current example embodiment, a sigmoid function is used as an embodiment of a non-linear filter. It would be apparent to those of ordinary skill in the technical field to which the current embodiment pertains that a function having non-linear response characteristics may be applied as a non-linear filter according to the current embodiment, in addition to the sigmoid function.

In the current example embodiment, a method of efficiently extracting a target sound signal from a mixed signal by using the non-linear filter 850 having a similar shape to the sigmoid function will be described. Also, in the current example embodiment, the sigmoid function which is adaptive to frequency and time is used for filtering adaptively to an ambient environment.

More specifically, an emphasized signal Y(t) 811 and a suppressed signal Z(t) 812 which are generated using a beam former (not shown) are respectively reconfigured as individual frames via window functions 821 and 822. For convenience of calculation, the reconstructed emphasized signal and suppressed signal are respectively transformed into the time-frequency domains via FFT units 831 and 832. It would be apparent to those of ordinary skill in the technical field to which the current embodiment pertains that the above process is similar to the operation described above with reference to FIG. 5.

Figure 9:
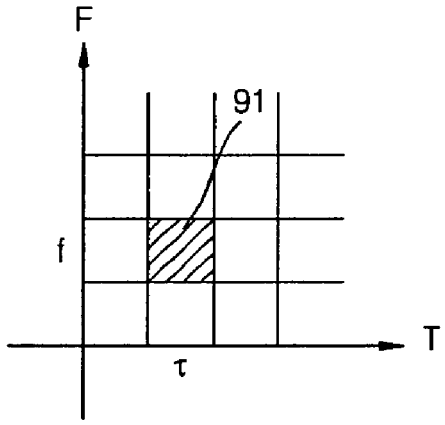
FIG. 9 is a graph illustrating the concept of frame index and frequency index.

The emphasized signal Y(t) is transformed into an emphasized signal Y(τ,f) via the window function 821 and the FFT unit 831, and the suppressed signal Z(t) is transformed into a suppressed signal Z(τ,f) via the window function 822 and the FFT unit 832. In this case, τ denotes frame index and f denotes frequency index. FIG. 9 is a graph illustrating the concept of the frame index T and frequency index f.

Referring to FIG. 9, the time axis T and the frequency axis f are respectively divided into a plurality of frames in the time-frequency domain. In this case, one local section 91 is defined by the frame index τ and the frequency index f.

Referring back to FIG. 8, a non-linear filter calculation unit 840 calculates the non-linear filter 850 from the emphasized signal Y(τ, f) and the suppressed signal Z(τ, f) which are respectively received from the FFT units 831 and 832. In the current example embodiment, the non-linear filter 850 is an embodiment of a masking filter used for extracting a target sound signal from a mixed sound signal. In the current example embodiment, the sigmoid function is used as an example of the non-linear filter 850.

The non-linear filter calculation unit 840 includes an amplitude ratio calculation unit 841, a frequency-adaptive coefficient calculation unit 842, and an interference signal ratio adaptive coefficient calculation unit 843. In detail, the non-linear filter calculation unit 840 calculates the sigmoid function by respectively using an amplitude ratio, a frequency-adaptive coefficient, and an SNR of a mixed signal as an input variable, an inclination coefficient, and a bias coefficient of the sigmoid function.

The amplitude ratio calculation unit 841 calculates an amplitude ratio $SNR_{TF}(\tau, f)$ of the emphasized signal Y(τ, f) to the suppressed signal Z(τ, f). The amplitude ratio $SNR_{TF}(\tau, f)$ may be used as the input variable of the sigmoid function and be defined, for example, in Equation 6:

$$SNR_{TF}(\tau, f) = \frac{|Y(\tau, f)|}{|Z(\tau, f)| + \varepsilon} \quad \text{Equation 6}$$

Here, the amplitude ratio $SNR_{TF}(\tau, f)$ denotes a local signal-to-noise ratio (SNR), |Y(τ, f)| denotes the amplitude of the emphasized signal Y(τ, f), |Z(τ, f)| denotes the amplitude of the suppressed signal Z(τ, f), and ϵ denotes a flooring term prepared for a case where the amplitude of the suppressed signal Z(τ, f) is 0 (zero). The local SNR defined in Equation 6 denotes an amplitude ratio of an emphasized signal to a suppressed signal in the local section 91 illustrated in FIG. 9. It would be apparent to those of ordinary skill in the technical field to which the current embodiment pertains that Equation 6 is just an embodiment of an equation for calculating an amplitude ratio or a local SNR and the current example embodiment is not limited thereto. The flooring term is further considered in Equation 6 for calculating the amplitude ratio $SNR_{TF}(\tau, f)$, compared to Equation 2 for calculating the amplitude ratio α(τ, f).

An amplitude ratio means the reliability of each of units being divided into frames. For example, if the amplitude ratio of the emphasized signal Y(τ, f) to the suppressed signal Z(τ, f) in a certain unit is large, this unit is a sound signal in which a target sound signal prevails. If the amplitude ratio is small, this unit is a sound signal in which interference noise prevails. Thus, the greater the amplitude ratio $SNR_{TF}(\tau, f)$ in Equation 6, the more an output of the non-linear filter 850, i.e., the sigmoid function, non-linearly increases.

The frequency-adaptive coefficient calculation unit 842 generates an inclination coefficient of the non-linear filter, i.e., the sigmoid function, by using the frequency index f. The sound of a high-frequency component, for example, of 3 KHz or more, has relatively low energy and is thus easy to be influenced by noise. Thus, the reliability of a local SNR in a high-frequency region is low. Accordingly, the inclination of the sigmoid function is set to be inversely proportional to frequency.

More specifically, if the inclination of the sigmoid function ranges from about $\sigma_1$ to about $\sigma_2$, the inclination of the sigmoid function may be expressed using for example, Equation 7.

$$\gamma(f) = \frac{\sigma_2}{f^m} \quad \text{Equation 7}$$

Here, γ(f) denotes the inclination of the sigmoid function, $\sigma_2$ denotes a maximum inclination of the sigmoid function, f denotes frequency in a corresponding local area, and m denotes a smoothing parameter and may be defined, for example, in Equation 8.

$$m = \frac{\log(\sigma^2/\sigma_1)}{\log(NFFT/2)} \quad \text{Equation 8}$$

Here, m denotes a smoothing parameter, NFFT denotes the number of sample points when performing fast Fourier transformation (FFT), and $\sigma_1$ and $\sigma_2$ respectively denote a minimum value and a maximum value that the inclination of the sigmoid function may have. The minimum and maximum values $\sigma_1$ and $\sigma_2$ of the inclination of the sigmoid function may be arbitrarily determined according to a usage environment.

Figure 10:
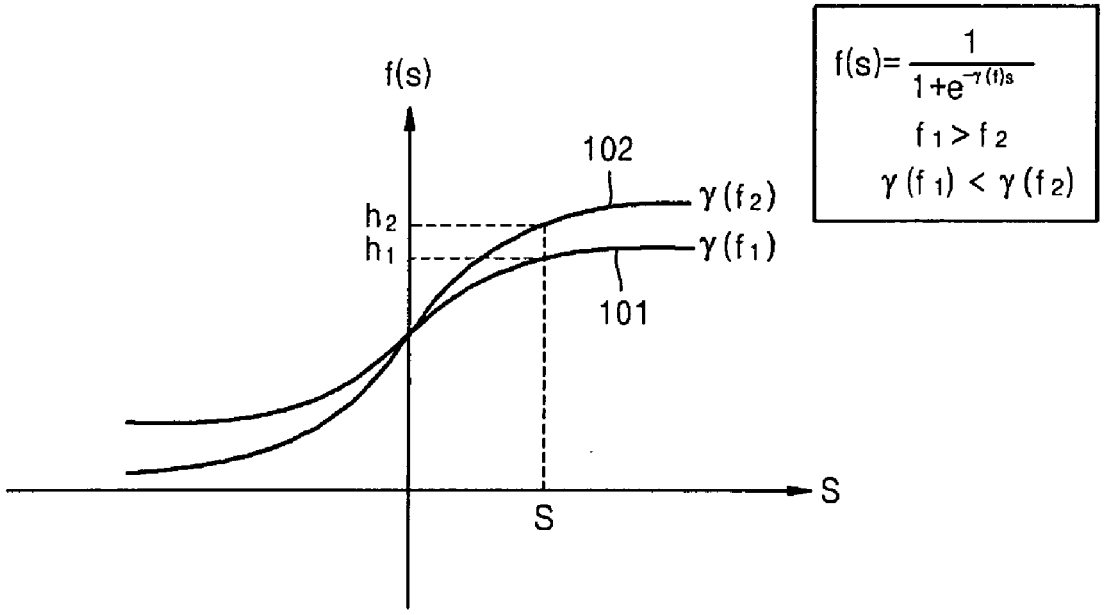
FIG. 10 is a graph illustrating an output of a sigmoid function versus an inclination thereof.

More specifically, an output of the sigmoid function varies according to the inclination γ(f) thereof. FIG. 10 is a graph illustrating an output of a sigmoid function versus an inclination thereof. For convenience of explanation, the sigmoid function may be defined, for example, as in Equation 9.

$$f(s) = \frac{1}{1 + e^{-\gamma(f)s}} \quad \text{Equation 9}$$

In the sigmoid function having an input variable s, γ(f) denotes the inclination of the sigmoid function which is adaptive to frequency, and f(s) denotes an output value of the sigmoid function. When frequency $f_1$ is greater than frequency $f_2$, inclination $\gamma(f_2)$ is greater than inclination $\gamma(f_1)$ since the inclination of the sigmoid function is inversely proportional to frequency. Thus, if it is assumed that the sigmoid function has the same input variable s, a graph 101 of the sigmoid function, the inclination of which is $\gamma(f_1)$ and a graph 102 of the sigmoid function, the inclination of which is $\gamma(f_2)$ are as illustrated in FIG. 10. Also, an output value $h_2$ of the sigmoid function is greater than an output value $h_1$ thereof. Accordingly, the relationship between frequency and the sigmoid function may be defined, for example, as in Equation 10 below.

$$\frac{1}{1+e^{-\gamma(f_2)S}} > \frac{1}{1+e^{-\gamma(f_1)S}}, \text{ if } f_1 > f_2, \gamma(f_1) < \gamma(f_2) \quad \text{Equation 10}$$

The current example embodiment is not limited to the above description, and it would be obvious to those of ordinary skill in this art that the inclination γ(f) of the sigmoid function may be defined using a coefficient causing the inclination of the non-linear filter 850 (FIG. 8) to decrease when frequency increases or vice versa. Referring again to FIG. 8, the frequency-adaptive coefficient calculation unit 841 sets a coefficient of the non-linear filter 850 to be adaptive to the frequencies of the emphasized signal Y(τ, f) and the suppressed signal Z(τ, f), thereby allowing the non-linear filter 850 to be transformed adaptively to frequency and a high-sensitive target sound signal to be extracted.

The non-linear filter 850 is capable of performing high-sensitivity masking on a target sound signal by applying the inclination γ(f) of the sigmoid function, which is adaptive to frequency, to a soft masking filter defined in Equation 5 when the inclination of the sigmoid function is set to γ.

The interference signal ratio adaptive coefficient calculation unit 843 generates a bias coefficient γ(τ) of the sigmoid function from the amplitudes of the emphasized signal Y(τ, f) and the suppressed signal Z(τ, f) respectively received from the FFT units 831 and 832. The bias coefficient β(τ) of the sigmoid function represents the bias of the sigmoid function. The bias coefficient β(τ) of the sigmoid function varies according to frame index τ. That is, a ratio of an interference signal to of a mixed signal in a region with the frame index τ0 may be used as the bias coefficient β(τ) of the sigmoid function. Thus, the bias coefficient β(τ) of the sigmoid function in the current example embodiment changes adaptively to the frame index τ, i.e., time. In detail, the bias coefficient β(τ) of the sigmoid function in the current example embodiment changes adaptively to a ratio of an interference signal to a mixed signal in a frame. In the current embodiment, the bias coefficient β(τ) of the sigmoid function may be defined, for example, as in Equation 11 below.

$$\beta(\tau) = \lambda_1 + \lambda_2\left(\frac{\Sigma_{\forall f}|Z(\tau, f)|}{\Sigma_{\forall f}|Y(\tau, f)| + \Sigma_{\forall f}|Z(\tau, f)|}\right) \quad \text{Equation 11}$$

Here, β(τ) denotes the bias coefficient of the sigmoid function, $\lambda_1$ denotes a minimum value of the bias coefficient β(τ) of the sigmoid function, and $(\lambda_1+\lambda_2)$ denotes a maximum value of the bias coefficient β(τ) of the sigmoid function. Also, |Y(τ, f)| denotes the amplitude of the emphasized signal Y(τ, f), and |Z(τ, f)| denotes the amplitude of the suppressed signal Z(τ, f). In this case, the minimum and maximum values $\lambda_1$ and $(\lambda_1+\lambda_2)$ of the bias coefficient β(τ) of the sigmoid function may be adjusted according to a usage environment.

Figure 11:
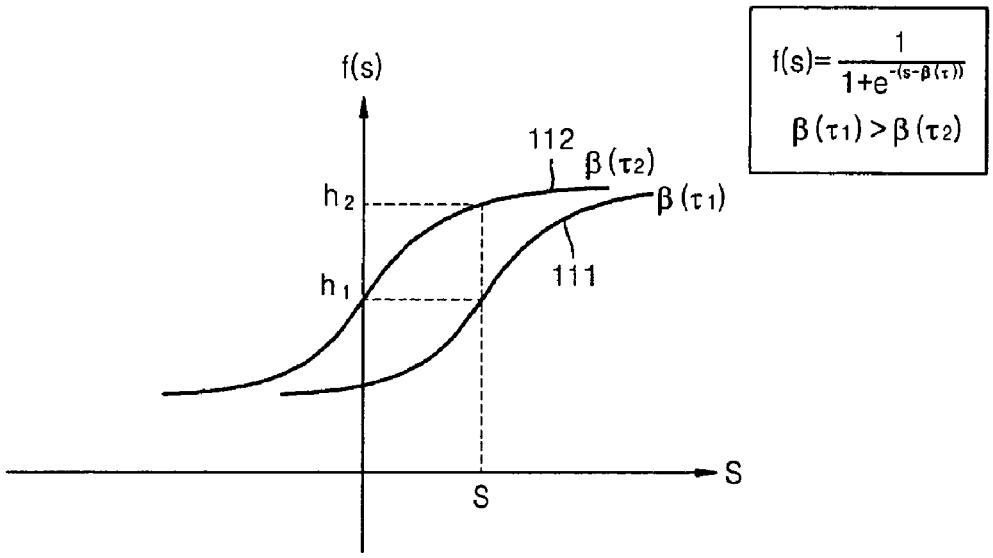
FIG. 11 is a graph illustrating an output value of the sigmoid function versus a bias coefficient thereof.

More specifically, the ratio of the interference signal to the mixed signal is calculated by summing the amplitudes in all frequency bands in a region with the frame index τ. That is, the amplitudes of emphasized signals and the amplitudes of suppressed signals in all frequency bands in a certain time zone are respectively added together. A ratio of the suppressed signals to the emphasized and suppressed signals in a certain frame is calculated using the calculated amplitudes. According to Equation 11, the greater the ratio of the suppressed signals to the emphasized and suppressed signal, the greater the bias coefficient β(τ) of the sigmoid function. For example, if the sum of the amplitudes of the emphasized signals is '0', the bias coefficient β(τ) has the maximum value $\lambda_1+\lambda_2$, and if the sum of the amplitudes of the suppressed signals is '0', the bias coefficient β(τ) has the minimum value $\lambda_1$. FIG. 11 is a graph illustrating an output value of the sigmoid function versus a bias coefficient thereof. For convenience of explanation, the sigmoid function may be defined, for example, as in Equation 12 below.

$$f(s) = \frac{1}{1+e^{-(s-\beta(\tau))}} \quad \text{Equation 12}$$

Here, in the sigmoid function having an input variable s, β(τ) denotes the bias coefficient of the sigmoid function that changes adaptively to time, which is calculated according to Equation 11, and f(s) denotes an output value of the sigmoid function. If it is assumed that a bias coefficient $\beta(\tau_1)$ is greater than a bias coefficient $\beta(\tau_2)$ in frames $\tau_1$ and $\tau_2$, that is, that a ratio of an interference signal to a mixed signal in the $\tau_1$ is greater than in the frame $\tau_2$, then a graph 111 of the sigmoid function having the bias coefficient $\beta(\tau_1)$ is more biased toward an axis S than a graph 112 of the sigmoid function having the bias coefficient $\beta(\tau_2)$. Thus, if the sigmoid function has the same input variable s, the graph 111 and the graph 112 are as illustrated in FIG. 11. As a result, the output value $h_2$ of the sigmoid function is greater than the output value $h_1$ thereof. Accordingly, the relationship between time and the sigmoid function may be defined, for example, as in Equation 13 below.

$$\frac{1}{1+e^{-(s-\beta(\tau_2))}} > \frac{1}{1+e^{-(s-\beta(\tau_1))}}, \text{ if } \beta(\tau_1) > \beta(\tau_2) \quad \text{Equation 13}$$

The current embodiment is not limited to the above description, and it would be obvious to those of ordinary skill in this art that the bias coefficient β(τ) of the sigmoid function may be defined using a coefficient causing the output value of the non-linear filter 850 (FIG. 8) to decrease when the ratio of the interference signal to the mixed signal increases or vice versa. Referring again to FIG. 8, the interference signal ratio adaptive coefficient calculation unit 843 sets a coefficient of the non-linear filter 850 to change adaptively to a ratio of the interference signal to a mixed signal in a certain frame. The non-linear filter 850 having the set coefficient is capable of extracting a high-sensitivity target sound signal since it may be changed adaptively to the ratio of the interference signal to a mixed signal according to time.

The non-linear filter calculation unit 840 calculates the non-linear filter 850 from a coefficient received from at least one of the amplitude ratio calculation unit 841, the frequency-adaptive coefficient calculation unit 842, and the interference signal ratio adaptive coefficient calculation unit 843. In the current example embodiment, if the non-linear filter 850 is the sigmoid function, then it may be defined, for example, as in Equation 14 below.

$$\tilde{M}(\tau, f) = \frac{1}{1+e^{-\gamma(f)(SNR_{TF}(\tau,f)-\beta(\tau))}} \quad \text{Equation 14}$$

Here, (τ, f) denotes a non-linear filter, γ(f) denotes an inclination coefficient calculated by the frequency-adaptive coefficient calculation unit 842, $SNR_{TF}(\tau, f)$ denotes an amplitude ratio calculated by the amplitude ratio calculation unit 841, and $\beta(\tau)$ denotes a bias coefficient calculated by the interference signal ratio adaptive coefficient calculation unit 843. The non-linear filter 850 receives an amplitude ratio-adaptive coefficient as an input variable, and obtains at least one of a frequency-adaptive inclination coefficient and an interference ratio-adaptive bias coefficient. However, it would be obvious to those of ordinary skill in the art that when an inclination coefficient and a bias coefficient are not respectively used adaptively to frequency and an interference signal ratio, predetermined values may be used as the inclination coefficient and a bias coefficient.

Figure 12:
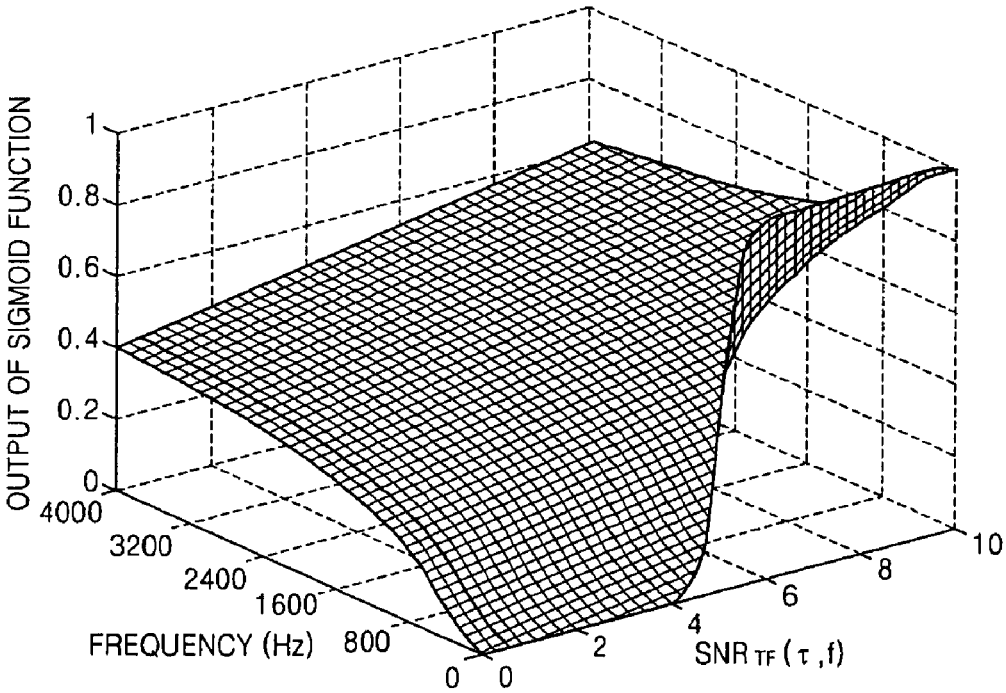
FIG. 12 illustrates an output value of an example embodiment of a non-linear filter.

FIG. 12 illustrates an output value of an example embodiment of a non-linear filter, e.g., the non-linear filter 850. Referring to FIG. 12, for convenience of illustration, it is assumed that an inclination $\gamma(f)$ changes within a range from about 0.5 to about 5.0, the number of FFT sample points is 512, and a base coefficient $\beta(\tau)$ is 5.0. FIG. 12 illustrates an output value of the non-linear filter 850 according to frequency when a local SNR, $SNR_{TF}(\tau, f)$, is an input variable of the non-linear filter 850. Referring to FIG. 12, the lower the frequency of a sound signal, the greater the SNR in a local area, the greater the output value of the non-linear filter 850. Accordingly, a high-sensitivity target sound signal may be extracted from a mixed signal, irrespective of musical noise or noise caused by a rapid change in an ambient environment.

Referring back to FIG. 2A, the signal extractor 230 filters the emphasized signal $Y(\tau)$ 251 by using the masking filter 231, which is set as described above, and finally extracts the target sound signal $O(\tau,f)$ (240). The extracted target sound signal $O(\tau,f)$ (240) may be defined by Equation 15, for example.

$$O(\tau,f)=\tilde{M}(\tau,f)\cdot Y(\tau,f) \qquad \text{Equation 15}$$

Since the extracted target sound signal $O(\tau,f)$ (240) is a value in the time-frequency domain, it is inverse FFTed into a value in the time domain.

The apparatus for extracting a target sound signal when information regarding the direction of a target sound source is given has been described above with reference to FIG. 2A. The apparatus according to example embodiments may clearly separate a target sound signal from a mixed sound signal, which contains a plurality of sound signals, input to a microphone array.

The apparatus for extracting a target sound signal when information regarding the direction of a target sound source is not given will now be described.

FIG. 2B is a block diagram of another example embodiment of an apparatus for extracting a target sound signal when information regarding the direction of a target sound source is not given. Like the apparatus of FIG. 2A, the apparatus of FIG. 2B includes a microphone array 210, a beam former 220 and a signal extractor 230. Unlike the apparatus of FIG. 2A, the apparatus of FIG. 2B further includes a sound source search unit 223. A description of the present example embodiment will be focused on the difference between the apparatuses of FIGS. 2A and 2B.

When information regarding the position of a target sound source is not given, the sound source search unit 223 searches for the position of the target sound source in the microphone array 210 using various algorithms which will be described below. As described above, a sound signal having dominant signal characteristics, that is, the sound signal having the biggest gain or sound pressure, from among a plurality of sound signals contained in a mixed sound signal is generally determined as a target sound source. Therefore, the sound source search unit 223 detects the direction or position of the target sound source based on the mixed sound signal which is input to the microphone array 210. In this case, dominant signal characteristics of a sound signal may be identified based on objective measurement values such as a signal-to-noise ratio (SNR) of the sound signal. Thus, the direction of a sound source, which generated a sound signal having relatively higher measurement values, may be determined as the direction in which a target sound source is located.

Various methods of searching for the position of a target sound source, such as time delay of arrival (TDOA), beam forming and high-definition spectral analysis, have been widely introduced and will be briefly described below.

In TDOA, the difference in the arrival times of a mixed sound signal at each pair of microphones of the microphone array 210 is measured, and the direction of a target sound source is estimated based on the measured difference. Then, the sound source search unit 223 estimates a spatial position, at which the estimated directions cross each other, to be the position of the target sound source.

In beam forming, the sound source search unit 223 delays a sound signal which is received at a particular angle, scans sound signals in space at each angle, selects a direction, in which a sound signal having a highest value is scanned, as the direction of a target sound source, and estimates a position, at which a sound signal having a highest value is scanned, to be the position of a target sound source.

The above methods of searching for the position of a target sound source would be obvious to those of ordinary skill in the art to which the example embodiments pertain, and thus a more detailed description thereof will be omitted (Juyang Weng, "Three-Dimensional Sound Localization from Compact Non-Coplanar Array of Microphones Using Tree-Based Learning," pp. 310-323, 110(1), JASA2001).

After the sound source search unit 223 determines the direction of the target sound source according to the various example embodiments described above, it transmits the mixed sound signal to an emphasized signal beam former 221 and a suppressed signal beam former 222 based on the determined direction of the target sound source. The subsequent process is identical to the process described above with reference to FIG. 2A. The apparatus according to the present example embodiment may clearly separate a target sound signal from a mixed sound signal, which contains a plurality of sound signals, input to a microphone array when information regarding the direction of a target sound source is not given.

Figure 13:
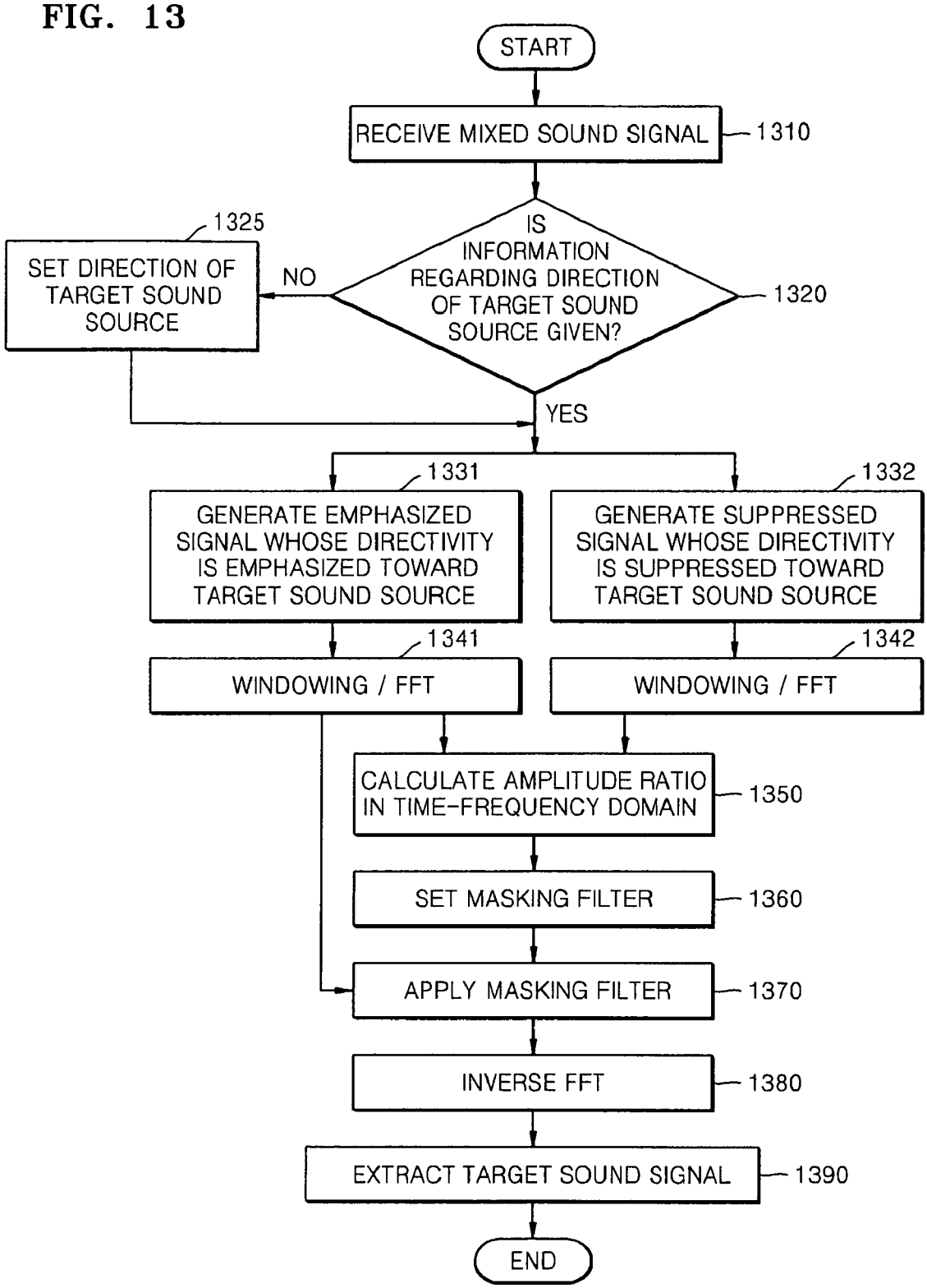
FIG. 13 is a flowchart illustrating an example embodiment of a method of extracting a target sound signal.

FIG. 13 is a flowchart illustrating an example embodiment of a method of extracting a target sound signal. Referring to FIG. 13, in operation 1310, a mixed sound signal is received via a microphone array from a plurality of sound sources placed around the microphone array. In operation 1320, it is determined whether information regarding the direction of a target sound source is given. Operation 1325 may be skipped. If the information regarding the direction of the target sound source is given, operation 1325 is skipped, and a next operation is performed. If the information regarding the direction of the target sound source is not given, operation 1325 is performed. That is, a sound source, which generates a sound signal having dominant signal characteristics, is detected from the sound sources, and the direction in which the sound source is located is set as the direction of the target sound source. This operation corresponds to the sound source search operation performed by the sound source search unit 223 which has been described above with reference to FIG. 2B.

In operations 1331 and 1332, an emphasized signal whose directivity is emphasized toward the target sound source and a suppressed signal whose directivity is suppressed toward the target sound source are generated. These operations correspond to the operations performed by the emphasized signal beam former 221 and the suppressed signal beam former 222 which have been described above with reference to FIGS. 2A and 2B.

In operations 1341 and 1342, the emphasized signal and the suppressed signal generated in operations 1331 and 1332, respectively, are filtered using a window function. Each of operations 1341 and 1342 corresponds to a process of dividing a continuous signal into a plurality of individual frames of uniform size in order to perform a convolution operation on the continuous signal. The individual frames are FFTed into frames in the time-frequency domain. That is, the emphasized signal and the suppressed signal are transformed into those in the time-frequency domain in operations 1341 and 1342.

In operation 1350, an amplitude ratio of the emphasized signal to the suppressed signal in the time-frequency domain is calculated. The amplitude ratio provides information regarding a ratio of a target sound to an interference noise which is contained in an individual frame of sound signal.

In operation 1360, a masking filter is set based on the calculated amplitude ratio. The methods of setting a masking filter according to two example embodiments have been suggested above; a method of setting a masking filter by using a binary masking filter and a masking threshold value, and a method of directly setting a soft masking filter by using a sigmoid function.

In operation 1370, the set masking filter is applied to the emphasized signal. That is, the emphasized signal is multiplied by the masking filter so as to extract a target sound signal.

In operation 1380, the extracted target sound signal is inverse FFT-ed into a target sound signal in the time domain. The target sound signal in the time domain is finally extracted in operation 1390.

Figure 14:
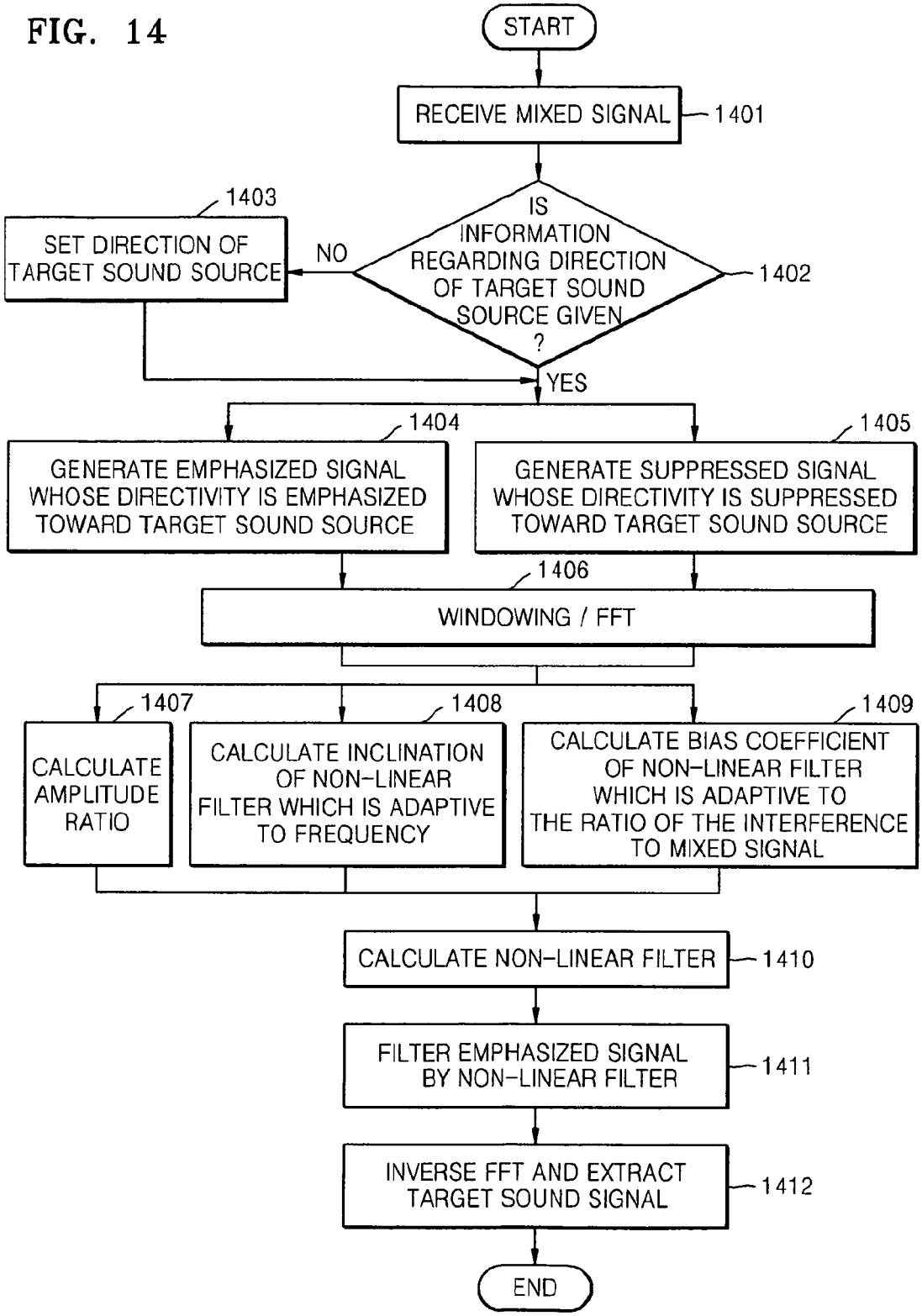
FIG. 14 is a flowchart illustrating another example embodiment of a method of extracting a target sound signal by using a non-linear filter.

FIG. 14 is a flowchart illustrating another example embodiment of a method of extracting a target sound signal by using a non-linear filter. The method of FIG. 14 includes operations being sequentially performed by the apparatus of FIG. 2A or 2B for extracting a target sound signal. Thus, although not described here, the above description of the apparatus of FIG. 2A or 2B may also be applied to the method of FIG. 14.

In operation 1401, a mixed signal is received via a microphone array. As illustrated in FIG. 1, an embodiment of a mixed signal may include a target sound source and interference noise.

In operation 1402, it is determined whether information regarding the direction of the target sound source is given. If this information is given, operation 1403 is skipped. That is, if this information does not need to be collected or is given, operation 1403 is skipped.

In operation 1403, when this information is not given, a sound source generating a sound signal having dominant signal characteristics is detected from among a plurality of sound sources placed around the microphone array, and the direction in which the sound source is located is set as the direction of the target sound source. Operation 1403 corresponds to the sound source search operation performed by the sound source search unit 223 which has been described above with reference to FIG. 2B.

In operation 1404, an emphasized signal having directivity toward the target sound source is generated from the mixed signal. In operation 1405, a suppressed signal whose directivity is suppressed toward the target sound source, is generated from the mixed signal. These operations are as described above with respect to the emphasized signal beam former 221 and the suppressed signal beam former 222 of FIGS. 2A and 2B.

In operation 1406, the emphasized signal and the suppressed signal generated in operations 1404 and 1405 are filtered using window functions and then are FFTed. When each of these signals passes through the corresponding window function, it is divided into frames in the time-frequency domain. Then, the emphasized signal and the suppressed signal which are defined in the time domain are FFTed respectively into an emphasized signal $Y(\tau, f)$ and a suppressed signal $Z(\tau, f)$ in the time-frequency domain.

In operation 1407, an amplitude ratio of the emphasized signal $Y(\tau, f)$ to the suppressed signal $Z(\tau, f)$ is calculated. The amplitude ratio provides information regarding a ratio of the emphasized signal to the suppressed signal in an individual frame of the sound signal. The amplitude ratio is used as an input variable of a non-linear filter. The greater the amplitude ratio, the greater an output value of the non-linear filter.

In operation 1408, an inclination of the non-linear filter, which changes adaptively to frequency, is determined using the FFT operation performed in operation 1406. The inclination of the non-linear filter may be determined to be inversely proportional to frequency. Since a sound signal in a high-frequency region is generally weak to noise, this sound signal is filtered by the non-linear filter in order to have a low output value. Accordingly, the higher the frequency, the lower the output value of the non-linear filter.

In operation 1409, a bias coefficient of the non-linear filter, which changes adaptively to a ratio of an interference signal to a mixed signal with respect to a time frame, is calculated using the emphasized signal $Y(\tau, f)$ and the suppressed signal $Z(\tau, f)$ in the time-frequency domain. The bias coefficient indicates the bias of the non-linear filter. The greater the interference signal ratio in the time frame, the less the output value of the non-linear filter.

In operation 1410, the non-linear filter is calculated based on the amplitude ratio, inclination, and the bias coefficient calculated in operations 1407 to 1409.

In operation 1411, the emphasized signal $Y(\tau, f)$ is filtered by the non-linear filter. That is, the emphasized signal $Y(\tau, f)$ is filtered by the non-linear filter in order to extract a target sound signal having no noise therefrom.

In operation 1412, the extracted target sound signal is inverse FFT-ed into a target sound signal in the time domain. The target sound signal in the time domain is finally extracted.

According to the above embodiments, it is possible to extract a high-sensitivity target sound signal by using a non-linear filter which is adaptive to frequency and an interference signal ratio even when interference noise is suddenly generated or surplus noise is generated. Also, it is possible to extract a clean target sound signal from a mixed signal containing interference noise. In particular, a high-sensitivity sound signal with the high PESQ index may be extracted even if the distances between microphones of a microphone array are too close.

In addition to the above described embodiments, example embodiments may also be implemented through computer readable code/instructions in/on a medium, e.g., a computer readable medium, to control at least one processing device to implement any above described embodiments and display the resultant image on a display. The medium can correspond to any medium/media permitting the storing and/or transmission of the computer readable code.

The computer readable code can be recorded on a recording medium in a variety of ways, with examples including magnetic storage media (e.g., ROM, floppy disks, hard disks, etc.) and optical recording media (e.g., CD-ROMs, or DVDs). The computer readable code can also be transferred on transmission media. The media may also be a distributed network, so that the computer readable code is stored/transferred and executed in a distributed fashion. Still further, as only an example, the processing device could include a processor or a computer processor, and processing elements may be distributed and/or included in a single device.

As described above, it is possible to extract a target sound signal having high PESQ index (Perceptual Evaluation of Speech Quality) from a mixed signal by using a non-linear filter which is adaptive to an amplitude ratio, frequency and a ratio of an interference signal to a mixed signal, irrespective of musical noise or noise generated due to a sudden change in an ambient environment.

While example embodiments have been particularly shown and described above, it should be understood that these exemplary embodiments should be considered in a descriptive sense only and not for purposes of limitation. Descriptions of features or aspects within each embodiment should typically be considered as available for other similar features or aspects in other embodiments.

Thus, although a few embodiments have been shown and described, it would be appreciated by those skilled in the art that changes may be made in these example embodiments without departing from the principles and spirit of the invention, the scope of which is defined in the claims and their equivalents.

What is claimed is:

1. A method of adaptively extracting a target sound signal from a mixed signal, the method comprising:

obtaining the mixed signal from a microphone array;

generating a first signal which is emphasized and directed toward a target sound source, and a second signal which is suppressed and directed toward the target sound source;

calculating a non-linear filter which is adaptive to at least one of an amplitude ratio of the first signal to the second signal in a time-frequency domain, frequencies of the first and second signals, and a ratio of an interference signal to the mixed signal; and filtering the first signal by the non-linear filter.

2. The method of claim 1, wherein the calculating of the non-linear filter comprises determining a coefficient of the non-linear filter in such a manner that the greater the amplitude ratio, the greater an output value of the non-linear filter.

3. The method of claim 1, wherein the calculating of the non-linear filter comprises determining a coefficient of the non-linear filter in such a manner that the greater the frequencies of the first and second signals, the smaller an output value of the non-linear filter.

4. The method of claim 1, wherein the calculating of the non-linear filter comprises determining a coefficient of the non-linear filter in such a manner that the greater the ratio of the interference signal to the mixed signal, the smaller an output value of the non-linear filter.

5. The method of claim 1, wherein the calculating of the non-linear filter comprises calculating the non-linear filter by using a sigmoid function which is adaptive to at least one of the amplitude ratio, the frequencies of the first and second signals, and the ratio of the interference signal to the mixed signal.

6. The method of claim 1, further comprising detecting a direction of the target sound source from the mixed signal by using a predetermined sound source search algorithm.

7. The method of claim 6, wherein the predetermined sound source search algorithm is used to determine a direction relative to the microphone array of a sound source generating a sound signal having a relatively high SNR (signal-to-noise ratio) compared to SNRs of sound signals generated by a plurality of sound sources around the microphone array, the determined direction directing towards the target sound source.

8. A computer readable recording medium on which a program causing a computer to execute the method of claim 1 is recorded.

9. An apparatus for adaptively extracting a target sound signal from a mixed signal, the apparatus comprising:

a microphone array receiving the mixed signal;

a beam former generating a first signal which is emphasized and directed toward a target sound source, and a second signal which is suppressed and directed toward the target sound source;

a non-linear filter calculation unit calculating a non-linear filter which is adaptive to at least one of an amplitude ratio of the first signal to the second signal in a time-frequency domain, frequencies of the first and second signals, and a ratio of an interference signal to the mixed signal; and a signal extractor extracting the target sound signal from the first signal by filtering the first signal by the non-linear filter.

10. The apparatus of claim 9, wherein the non-linear filter calculation unit comprises an amplitude ratio calculation unit calculating the amplitude ratio of the first signal to the second signal in the time-frequency domain, as an input variable of the non-linear filter.

11. The apparatus of claim 9, wherein the non-linear filter calculation unit comprises a frequency-adaptive coefficient calculation unit calculating an inclination coefficient of the non-linear filter by using the frequencies of the first and second signals.

12. The apparatus of claim 9, wherein the non-linear filter calculation unit comprises an interference signal ratio-adaptive coefficient calculation unit calculating the ratio of the interference signal to the mixed signal as a bias coefficient of the non-linear filter.

13. The apparatus of claim 9, further comprising a sound source search unit detecting a direction of the target sound source from the mixed signal by using a predetermined sound source search algorithm.

14. The apparatus of claim 13, wherein the predetermined sound source search algorithm is used to determine a direction relative to the microphone array of a sound source generating a sound signal having a relatively high SNR (signal-to-noise ratio) compared to SNRs of sound signals generated by a plurality of sound sources around the microphone array, the determined direction directing towards the target sound source.

* * * * *